United States Patent [19]

Matteo, Sr.

[11] 4,222,552

[45] Sep. 16, 1980

[54] HIGHWAY GUARDRAIL COVER

[76] Inventor: George W. Matteo, Sr., 1405 Chews Landing Rd., Laurel Springs, N.J. 08021

[21] Appl. No.: 952,966

[22] Filed: Oct. 20, 1978

Related U.S. Application Data

[63] Continuation-in-part of Ser. No. 817,842, Jul. 21, 1977.

[51] Int. Cl.[2] ..... E01F 15/00

[52] U.S. Cl. ..... 256/13.1; 403/313; 248/345.1

[58] Field of Search ..... 256/13.1, 1; 403/313, 403/363; 52/718; 248/345.1; 293/121, 142; 116/63 C, 63 T

[56] References Cited

U.S. PATENT DOCUMENTS

| | | | |
|---|---|---|---|
| D. 158,461 | 5/1950 | Hammerly . | |
| D. 189,447 | 12/1960 | Attwood . | |
| D. 199,024 | 9/1964 | Huret . | |
| D. 221,251 | 7/1971 | Haskell . | |
| 1,670,737 | 5/1928 | Muser | 293/142 |
| 1,682,858 | 9/1928 | Sipe | 293/121 |
| 2,106,601 | 1/1938 | Hunter | 256/13.1 |
| 2,118,800 | 5/1938 | Smith | 52/718 |
| 2,681,716 | 6/1954 | Black | 52/718 |
| 2,833,575 | 5/1958 | Haller et al. | 403/313 |
| 2,945,081 | 7/1960 | Bogese et al. | 52/718 X |
| 3,322,093 | 5/1967 | Goland et al. | 116/63 T |
| 3,550,338 | 12/1970 | Satkin et al. . | |
| 3,606,433 | 9/1971 | Kunevicius | 52/718 X |
| 3,618,556 | 11/1971 | Dittrich | 116/63 C |
| 3,825,229 | 7/1974 | Bartlett | 256/13.1 X |
| 3,856,194 | 12/1974 | Helm | 52/718 X |
| 3,861,110 | 1/1975 | Bartlett | 52/718 |

FOREIGN PATENT DOCUMENTS

| | | | |
|---|---|---|---|
| 222161 | 7/1961 | Austria | 256/13.1 |
| 1197110 | 7/1965 | Fed. Rep. of Germany | 256/13.1 |
| 194790 | 3/1965 | Sweden | 256/13.1 |

*Primary Examiner*—Andrew V. Kundrat
*Attorney, Agent, or Firm*—Bacon & Thomas

[57] ABSTRACT

A highway guardrail cover in the form of an elongate channel having a substantially C-shaped transverse cross-sectional configuration. The cover includes inwardly directed flanges for snap-fit attachment around opposed edge portions of the guardrail. The cover serves to enclose and protect the guardrail from deterioration and provide both a visible and uniform external appearance to motorists.

19 Claims, 4 Drawing Figures

HIGHWAY GUARDRAIL COVER

CROSS-REFERENCE TO RELATED APPLICATION

This application is a continuation-in-part of application Ser. No. 817,842, earlier filed on July 21, 1977.

BACKGROUND OF THE INVENTION

1. Field of the Invention

The present invention generally relates to devices for covering or enclosing elongate rail structures. More particularly, the invention is directed to a cover for enclosing and protecting metallic highway guardrails from physical deterioration, while simultaneously enhancing their external appearance and visibility.

2. Description of the Prior Art

Guardrail assemblies presently known and installed along highways typically comprise at least one horizontal guardrail section that is supported at spaced locations by a plurality of vertical posts anchored in the ground. Each guardrail section includes a plurality of individual guardrails joined in an end-to-end relationship, with each guardrail being generally in the form of a steel channel having a somewhat corrugated configuration that imparts rigidity and strength thereto. The guardrail section is fastened to the vertical posts by bolting, riveting or similar fastening expedient.

Metallic guardrails made of steel are subject to rapid deterioration through corrosion from constant exposure to rain and moisture. The problem of corrosion is further aggravated from the presence of salt which is normally deposited on the highways during wintertime. Attempts at preventing deterioration of guardrails through corrosion have generally been centered upon providing galvanized coatings of zinc over the exposed steel surfaces of the guardrails. While this expedient does provide some degree of protection against corrosion, it is vulnerable to attack by mechanical abrasion, such as caused by stones and other debris thrown against the guardrails by passing vehicles or high winds. These mechanical forces serve to damage and erode away the galvanized coatings on the guardrails, thereby permitting corrosion to rapidly occur at the exposed steel areas. The physical deterioration of guardrails through corrosion imparts an unsightly appearance to the guardrail assembly that is both time consuming and expensive to repair.

The prior art has taught that guardrail structures may be provided with covers for a variety of reasons, including enhancing external appearance and prevention of injury and damage through contact with the rail by a person or object. Such known covers, particularly when utilized in conjunction with large rail structures, normally require the use of adhesives or mechanical fasteners in order to assure a secure attachment to the rail structure. This situation has also proved to be both time consuming and costly when long lengths of guardrail sections must be covered.

SUMMARY OF THE INVENTION

It is an object of the present invention to provide an improved highway guardrail cover that is quickly attachable to existing guardrail assemblies without the necessity of utilizing separate fastening means.

It is another object of the invention to provide an improved guardrail cover that protects guardrail assemblies from physical deterioration through corrosion and mechanical abrasion.

It is still another object of the invention to provide an improved guardrail cover which serves to impart a highly visible and pleasing uniform external appearance to guardrail assemblies.

It is yet still another object of the invention to provide an improved guardrail cover which is extremely simple in construction and economical to manufacture.

These and other objects of the invention are realized through providing a guardrail cover that is preferably formed from a single piece of flexible material, such as extruded plastic. The cover is in the form of an elongate channel having a generally C-shaped cross-sectional configuration that is preferably uniform along the length thereof. The cover includes at least a main panel, two corner panels extending outwardly from the longitudinal edges of the main panel and forming obtuse angles therewith, and inwardly directed flanges carried by the corner panels for snap-fitting around and attaching the cover to opposed longitudinal edge portions of the guardrail. In another embodiment, the cover further includes a pair of parallel side panels and a second pair of corner panels for covering and enclosing a guardrail assembly having double guardrail sections. At least a portion of the exterior surface of the cover is preferably provided with an iridescent or colored finish in order to enhance its visibility to motorists. Plural covers are joined in an end-to-end abutting relationship by utilizing a bridging member having substantially the same transverse cross-sectional configuration as the covers being joined, though of a slightly larger size in order to accommodate overlapping and embracing abutting end portions of the cover joint.

Other objects, advantages and aspects of the invention and the various features of construction will become apparent to those skilled in this art upon reference to the following specification and the accompanying drawings forming a part hereof.

DETAILED DESCRIPTION OF THE PREFERRED EMBODIMENTS

Figure 1:
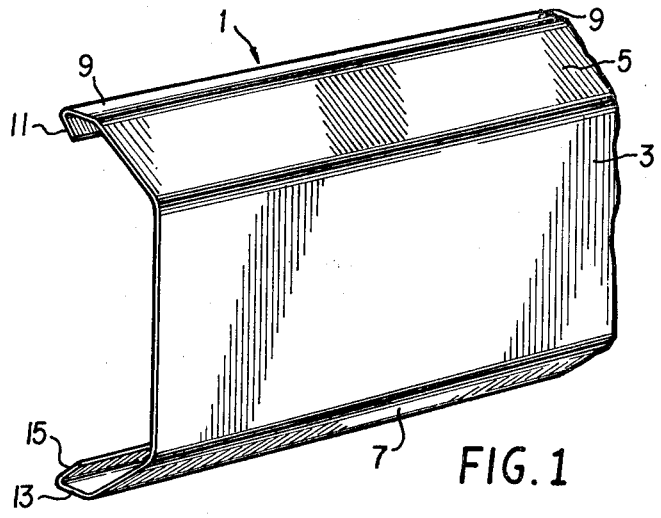
FIG. 1 is a fragmentary perspective view of a guardrail cover according to a first embodiment of the invention.

A guardrail cover 1 according to one embodiment of the invention is shown in FIG. 1 comprising an elongate channel having a generally C-shaped transverse cross-sectional configuration that is preferably uniform along the length thereof. Cover 1 includes a main panel 3 having a pair of corner panels 5 and 7 extending outwardly in a diverging manner from the longitudinal extremities of main panel 3 and forming obtuse angles therewith. The free longitudinal edges of corner panels 5 and 7 are each folded to form, respectively, an edge panel 9 with an associated inwardly directed flange 11 and an edge panel 13 with an inwardly directed flange 15.

Figure 2:
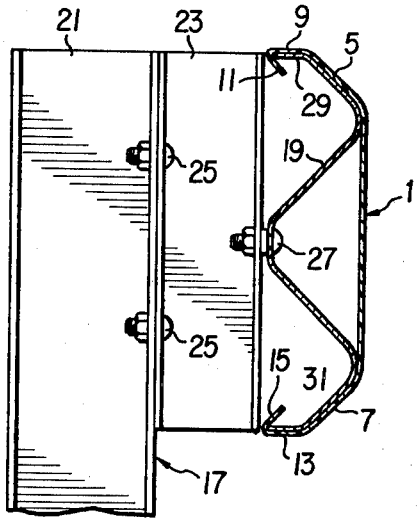
FIG. 2 is a fragmentary transverse cross-sectional view of a single guardrail section incorporating the guardrail cover shown in FIG. 1 within a guardrail assembly.

The transverse cross-sectional configuration of cover 1 and the advantages afforded thereby are more clearly depicted in FIG. 2 wherein cover 1 is shown attached to a guardrail assembly 17 having a single guardrail 19. Assembly 17 includes a vertical post 21 on which a spacer block 23 is mounted by means of a plurality of nut and bolt assemblies 25. Assembly 17 is typical of existing guardrail assemblies and includes a plurality of posts 21 placed within and spaced along the ground adjacent a highway, with a plurality of guardrails 19 being connected in an end-to-end fashion to form a continuous guardrail section which is secured to individual blocks 23 by utilizing a plurality of nut and bolt assemblies 27. Guardrail 19 has a somewhat corrugated cross-sectional configuration for the purpose of imparting strength and rigidity thereto.

As shown in FIG. 2, the transverse cross-sectional configuration of cover 1 is defined by main panel 3 which presents an exterior vertical face, corner panels 5 and 7 forming obtuse angles with main panel 3, edge panels 9 and 13 forming obtuse angles with corner panels 5 and 7, and flanges 11 and 15 preferably forming acute angles with edge panels 9 and 13. Guardrail 19 includes a pair of opposed longitudinal edges 29 and 31 around which flanges 11 and 15 are correspondingly disposed for the purpose of securely retaining cover 1 on guardrail 19. Because of the acute angles formed between flanges 11 and 15 and their respective edge panels 9 and 13, flanges 11 and 15 are inwardly directed to substantially converge towards main panel 3. Accordingly, once flanges 11 and 15 are disposed about edges 29 and 31 of guardrail 19, cover 1 becomes rigidly and securely attached to guardrail 19, serving to enclose and protect guardrail 19 from physical deterioration.

Cover 1 is preferably integrally formed from a single piece of synthetic polymer material, such as polystyrene, polypropylene, polyethylene or the like. It is advantageous to utilize a material which is inert to corrosive attack by weather and environmental conditions, as well as possessing sufficient physical strength to withstand attack by mechanical forces. Cover 1 may be made by any well known plastic molding or extrusion technique, or any other technique being suitable for the intended purpose of this invention.

By virtue of the transverse cross-sectional configuration of cover 1, it is apparent from FIG. 2 that cover 1 may be quickly attached to guardrail 19 by temporarily spreading the longitudinal edge portions of cover 1 so that flanges 11 and 15 are caused to be snap-fitted around edges 29 and 31 of guardrail 19. In order to accommodate this rapid attachment procedure, it is preferable to form cover 1 from relatively thin and flexible plastic material having a substantially uniform thickness. Because of the inwardly directed dispositions of flanges 11 and 15, cover 1 becomes securely attached to guardrail 19 without the need of additional or separate fastening means. However, in the event that permanent attachment of cover 1 to guardrail 19 be desired or if it is anticipated that cover 1 will be subjected to unusually severe environmental conditions, it would then be advantageous to bond cover 1 to guardrail 19 through the use of a suitable adhesive, such as epoxy or the like. Once in position on guardrail 19, cover 1 serves to entirely enclose and protect guardrail 19 and provides a uniform exterior appearance thereto.

In the embodiment depicted in FIG. 2, main panel 3 is disposed in a vertical orientation when cover 1 is attached to guardrail 19. Accordingly, the exterior face of main panel 3 is most apparent to motorists and serves to provide the primary indication as to the geographic location of guardrail assembly 17. It is therefore preferable that at least a portion of the exterior surface of cover 1, particularly the portion including main panel 3, be provided with an iridescent or other highly visible finish in order to enhance visibility and promote highway safety. When plastic materials is utilized to form cover 1, it may include the necessary additives or dyes which will provide the desired coloration or finish in the final product. Alternatively, cover 1 may be provided with any suitable coatings, such as paints and decals, in order to accomplish this same advantageous effect.

Referring now to FIG, 3, there is shown a guardrail cover 33 according to a second embodiment of the invention. Cover 33 is attached to a guardrail assembly 35 having a pair of guardrails 37 and 39, each of which also has a substantially corrugated cross-sectional configuration for strength and rigidity. Guardrails 37 and 39 are supported on a pair of spacer blocks 41 and 43 carried on opposite sides of a vertical post 45. Blocks 41 and 43 are attached to post 45 through a plurality of nut and bolt assemblies 47. Guardrails 37 and 39 are in turn secured to their corresponding blocks 41 and 43 through a pair of nut and bolt assemblies 49.

Figure 3:
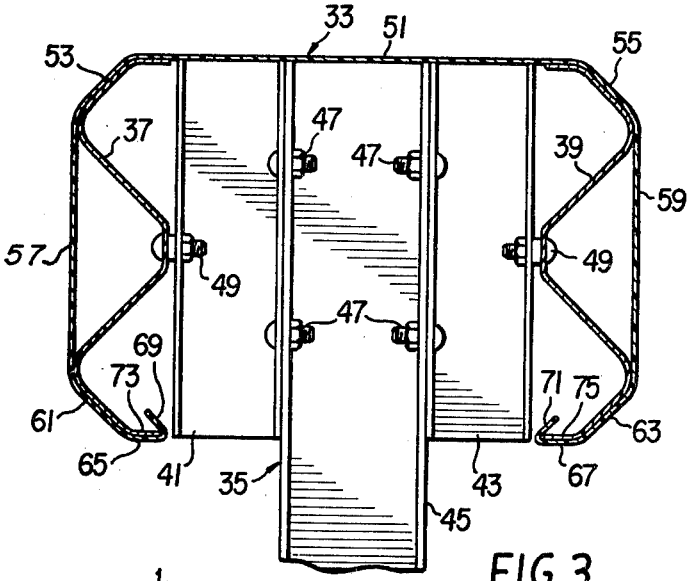
FIG. 3 is a fragmentary transverse cross-sectional view of a guardrail assembly having double guardrail sections incorporating a guardrail cover according to a second embodiment of the invention.

Like cover 1, cover 33 is also generally in the shape of an elongate channel having a substantially C-shaped transverse cross-sectional configuration. As shown in FIG. 3, the cross-sectional configuration of cover 33 is defined by a main panel 51, a pair of first corner panels 53 and 55, a pair of side panels 57 and 59, a pair of second corner panels 61 and 63, a pair of edge panels 65 and 67, and a pair of flanges 69 and 71. First corner panels 53 and 55 form obtuse angles with main panel 51. Side panels 57 and 59 are substantially parallel to each other. Second corner panels 61 and 63 form obtuse angles with their corresponding side panels 57 and 59. Flanges 69 and 71 are directed inwardly and form acute angles with their corresponding edge panels 65 and 67. Flanges 69 and 71 are disposed around a pair of opposed edge portions 73 and 75, respectively, of guardrails 37 and 39. Because of the inwardly directed orientations of flanges 69 and 71, they substantially diverge outwardly away from each other and towards their respective side panels 57 and 59. In this manner, cover 33 becomes securely and rigidly attached to assembly 35 and serves to completely enclose and protect guardrails 37 and 39 from physical deterioration.

Cover 33 also encloses blocks 41 and 43, thereby imparting an extremely pleasing and uniform external appearance to assembly 35. The configuration of cover 33 is such that main panel 51 provides an exterior horizontal face and side panels 57 and 59 provide exterior vertical faces, the latter being visible to motorists from both sides of assembly 35. Cover 33 may be made from the same materials and provided with the same type of exterior finish as previously indicated for cover 1. Cover 33 may also be made of any molding or extrusion technique well known in the art and is preferably also integrally formed from a single piece of relatively thin flexible material having a substantially uniform thickness.

Figure 4:
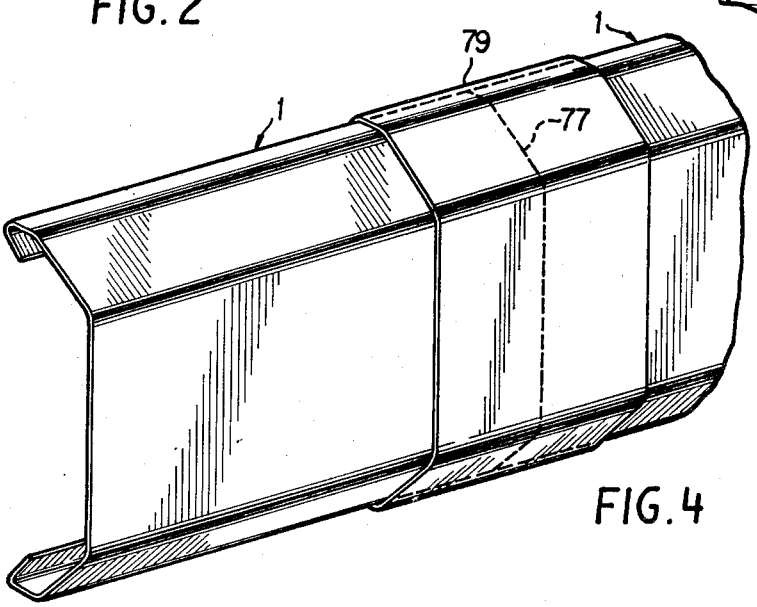
FIG. 4 is a fragmentary perspective view of the manner in which a pair of guardrail covers according to the invention are joined in an end-to-end relationship.

The manner in which plural lengths of a guardrail cover according to the invention may be connected together after the covers have been assembled onto a length of guardrail section shall now be described with reference to FIG. 4. As shown, a pair of covers 1 according to the first embodiment are disposed in an end-to-end abutting relationship, thereby forming a joint as indicated by dotted line 77. A bridging member 79 is then placed over joint 77 and extends for a short distance on either side thereof. As is apparent in FIG. 4, bridging member 79 has essentially the same transverse cross-sectional configuration as cover 1, though of a somewhat larger size in order to accommodate the corresponding end portions of covers 1 in a nested and close abutting relationship therewith. Bridging member 79 is preferably formed exactly in the same manner and provided with the same exterior appearance as that previously described for cover 1 so that it may be quickly snap-fitted over joint 77 and blend unobtrusively into the overall external appearance of covers 1.

By virtue of the corresponding cross-sectional configurations between bridging members 79 and its associated cover 1, a secure locking together of the corresponding abutting ends of covers 1 can be achieved by simply snap-fitting bridging member 79 over joint 77. However, when it is desired to form a permanent installation, a suitable adhesive such as epoxy may be utilized to secure bridging member 79 over joint 77. It is further apparent that covers 33 according to the second embodiment may also be joined in the manner described for covers 1, the only difference being bridging member 79 must then have the same transverse cross-sectional configuration as cover 33.

Though the cover of the present invention has been described as being particularly suitable for use in conjunction with guardrail assemblies having guardrails of the corrugated variety as depicted in FIGS. 2 and 3, it is to be clearly understood that the embodiments of the invention herein shown and described are to be taken as merely preferred examples of the same, and that various changes in the shapes, sizes, arrangement of parts, compositions and methods of use and operation may be resorted to, without departing from the spirit of the invention or scope of the subjoined claims.

What is claimed is:

1. A flexible cover for enclosing and protecting a rigid elongate highway guardrail from physical deterioration, which cover includes:

(a) a main panel;

(b) a pair of corner panels diverging outwardly from opposed portions of the main panel and defining obtuse angles therewith;

(c) an edge panel carried by each corner panel; and (d) an inwardly directed flange carried by each edge panel and defining an acute angle therewith for snap-fit attachment around a corresponding rigid portion of the guardrail.

2. The cover of claim 1 wherein the cover is of an elongate shape having a substantially C-shaped transverse cross-sectional configuration.

3. The cover of claim 2 wherein the C-shaped transverse cross-sectional configuration is substantially uniform along the entire length of the cover.

4. The cover of claim 1 wherein the edge panels are substantially parallel to each other and form obtuse angles with their corresponding corner panels.

5. The cover of claim 1 wherein the flanges are inwardly directed to coverge towards the main panel.

6. The cover of claim 1 wherein the cover is made from relatively thin flexible material having substantially uniform thickness.

7. The cover of claim 1 wherein the cover is integrally formed from a single piece of material.

8. The cover of claim 7 wherein the cover is formed from extruded plastic.

9. The cover of claim 8 wherein the plastic is selected from the group consisting of polystyrene, polypropylene, polyethylene and mixtures thereof.

10. The cover of claim 1 wherein at least a portion of its exterior surface includes an iridescent appearance for enhancing its visibility.

11. A cover assembly for enclosing and protecting a highway guardrail, which assembly comprises:

(a) a pair of elongate covers having substantially identical transverse cross-sectional configurations disposed in an end-to-end relationship and defining a joint therebetween, with each cover including:

1. a main panel;
2. a pair of first corner panels diverging outwardly from opposed portions of the main panel and defining obtuse angles therewith;
3. an edge panel carried by each first corner panel; and
4. an inwardly directed flange carried be each edge panel and defining an acute angle therewith for snap-fit attachment around a corresponding portion of the guardrail; and (b) a bridging member embracing the joint and extending laterally from either side thereof.

12. The assembly of claim 11 wherein the transverse cross-sectional configuration of the bridging member is substantially the same as that of the covers.

13. A cover for enclosing and protecting an elongate highway guardrail from physical deterioration, which cover includes:

(a) a main panel;

(b) a pair of first corner panels diverging outwardly from opposed portions of the main panel and defining obtuse angles therewith;

(c) a side panel extending from each first corner panel;

(d) a pair of second corner panels each converging inwardly from opposed portions a respective side panel;

(e) an edge panel carried by each second corner panel; and (f) an inwardly directed flange carried by each edge panel and defining an acute angle therewith for snap-fit attachment around a corresponding portion of the guardrail.

14. The cover of claim 13 wherein the flanges diverge away from each other towards their corresponding side panels.

15. The cover of claim 13 wherein the cover is made from relatively thin flexible material having substantially uniform thickness.

16. The cover of claim 13 wherein the cover is integrally formed from a single piece of material.

17. The cover of claim 16 wherein the cover is formed from extruded plastic.

18. The cover of claim 17 wherein the plastic is selected from the group consisting of polystyrene, polypropylene, polyethylene and mixtures thereof.

19. The cover of claim 13 wherein at least a portion of its exterior surface includes an iridescent appearance for enhancing its visibility.

* * * * *